US006056685A

United States Patent [19]

Nelson

[11] Patent Number: 6,056,685

[45] Date of Patent: May 2, 2000

[54] CENTRIFUGE HAVING SELECTIVELY OPERABLE HARMONIC DRIVE FOR SCROLL CONVEYOR

[75] Inventor: Kurt Nelson, Sarasota, Fla.

[73] Assignee: G-Force LLC, Fishers, Ind.

[21] Appl. No.: 09/313,119

[22] Filed: May 17, 1999

[51] Int. Cl.[7] ..... B04B 1/20; B04B 9/08

[52] U.S. Cl. ..... 494/53; 494/62; 494/65; 494/84

[58] Field of Search ..... 494/7, 52–54, 494/62, 65, 67, 83, 84; 210/364–366, 368, 377, 380.1; 74/640, 665 F, 665 K

[56] References Cited

U.S. PATENT DOCUMENTS

| | | | |
|---|---|---|---|
| 2,129,992 | 9/1938 | De Mattia . | |
| 2,622,794 | 12/1952 | Smith | 494/53 |
| 2,711,854 | 6/1955 | Kjellgren . | |
| 2,862,658 | 12/1958 | Dahlgren . | |
| 3,161,081 | 12/1964 | Musser | 74/640 |
| 3,419,211 | 12/1968 | Yasuda et al. | 494/84 |
| 3,487,722 | 1/1970 | Cline | 74/640 |
| 4,129,249 | 12/1978 | Todd . | |
| 4,228,949 | 10/1980 | Jackson . | |
| 4,715,247 | 12/1987 | Honda et al. . | |
| 5,123,300 | 6/1992 | Himmelein et al. | 74/640 |
| 5,269,202 | 12/1993 | Kiyosawa et al. . | |
| 5,354,255 | 10/1994 | Shapiro | 494/53 |
| 5,364,335 | 11/1994 | Franzen et al. | 494/84 |
| 5,494,579 | 2/1996 | Robatel et al. | 494/53 |
| 5,529,566 | 6/1996 | Weil . | |
| 5,772,573 | 6/1998 | Hao | 74/640 |
| 5,823,937 | 10/1998 | Carr | 494/65 |
| 5,879,279 | 3/1999 | Berger et al. | 494/84 |

*Primary Examiner*—Charles E. Cooley
*Attorney, Agent, or Firm*—Locke Reynolds LLP

[57] ABSTRACT

A centrifuge includes a frame, a hollow spindle supported by the frame for rotation about an axis, a bowl including a shell fixed to the spindle for rotation with the spindle, a shaft situated within and movable with respect to the hollow spindle, and a conveyor fixed to the shaft including a scroll situated adjacent an inner surface of the bowl shell. A harmonic drive unit including a housing is fixed to an end of the hollow spindle, the housing containing a circular spline fixed to the housing. The harmonic drive unit also includes a flexspline gear ring situated within and engaged with the circular spline, the flexspline gear ring being fixed to the shaft situated within the hollow spindle. The harmonic drive unit also includes a wave generator positioned within the flexspline gear ring for displacing the flexspline gear ring with respect to the circular spline. A brake rotor is coupled to the wave generator. A brake control unit is fixed to the frame, the brake control unit including a surface confronting the brake rotor for frictional engagement so that engagement of the brake rotor and confronting surface during rotation of the bowl shell will cause the flexspline gear, rotating relative to the wave generator, to precess relative to the circular spline. The precession of the flexspline gear causes the shaft coupled to the conveyor move relative to the rotating bowl shell, thereby dispensing separated solids out of the bowl shell.

16 Claims, 3 Drawing Sheets

CENTRIFUGE HAVING SELECTIVELY OPERABLE HARMONIC DRIVE FOR SCROLL CONVEYOR

BACKGROUND OF THE INVENTION

The present invention pertains to solid-shell centrifuges for separating solids from liquids that include a scroll for conveying the extracted solids out of the centrifuge and structure for supporting the scroll within the bowl shell. The invention particularly pertains to the drive means for selectively driving the scroll conveyor at a slightly different speed than the bowl shell during the solids conveying process while the centrifuge continues to operate.

Some centrifuges used to separate solid materials out of a stream of liquid are operated on an intermittent basis. After some period of operation with a stream of liquid passing through the centrifuge, the flow of liquid is terminated and the centrifuge stopped so that the separated solids can be removed from the centrifuge bowl. While such batch processing of some fluids is satisfactory, in many manufacturing situations, a continuous separation process is desired so that the flow of liquid does not have to be periodically terminated.

Centrifuges of the type having a helical conveying scroll mounted within a frustoconical centrifuge bowl are commonly employed to separate solids from liquids on a continuous or semi-continuous basis. Typically, a liquid-solid mixture or slurry is continuously introduced into the centrifuge, and occasionally or even continuously a rotary speed differential is established between the rotating bowl and the scroll so that the scroll can convey the separated solids out one end of the centrifuge bowl at the same time as separated liquid flows out the other end of the bowl. A wide variety of apparatus have been employed to attempt to achieve the speed differential between the scroll and bowl with varying success and reliability. The speed differential apparatus tends to be a relatively high maintenance item as compared to the remainder of the centrifuge. Examples of prior art speed differential apparatus are to be found in U.S. Pat. Nos. 4,129,249; 4,228,949; and 5,529,566.

An object of the present invention is to provide a centrifuge with a highly reliable speed differential drive apparatus for precessing the scroll slightly faster than the bowl shell on either a continuous or occasional basis to extract separated solids from the bowl while the centrifuge continues to separate solids from a stream of liquid. Another object of the present invention is to process the stream of liquid more effectively by providing means for accelerating the liquid as it is introduced which smoothly delivers the newly introduced liquid to the region of the maximum operating fluid level within the bowl as an essentially laminar flow.

SUMMARY OF THE INVENTION

A centrifuge of the present invention achieving these objects includes a frame, a hollow spindle supported by the frame for rotation about an axis, and a bowl including a shell fixed to the spindle for rotation with the spindle. A shaft is situated within and movable with respect to the hollow spindle, and a conveyor is fixed to the shaft, the conveyor including a scroll situated adjacent an inner surface of the bowl shell. A speed differential apparatus in the form of a harmonic drive unit is coupled to an end of the hollow spindle and to the shaft situated within the hollow spindle, and a brake rotor is coupled to an element of the harmonic drive unit. A brake control unit is fixed to the frame, the brake control unit including a surface confronting the brake rotor so that engagement of the brake rotor and confronting surface during rotation of the bowl shell will cause the harmonic drive unit to precess the shaft coupled to the conveyor to effect a relative movement between the conveyor and the rotating bowl shell, thereby dispensing separated solids out of the bowl shell.

The harmonic drive unit comprises a housing fixed to an end of the hollow spindle, the housing containing a circular spline fixed to the housing. A flexspline gear ring is situated within and engaged with the circular spline, the flexspline gear ring being fixed to the shaft situated within the hollow spindle coupled to the scroll conveyor. A wave generator is positioned within the flexspline gear ring for displacing the flexspline gear ring with respect to the circular spline, the wave generator being fixed to said brake rotor. When the brake rotor and confronting brake control surface are not engaged, the wave generator travels freely with the flexspline gear ring so that no relative movement occurs between the bowl shell and the scroll conveyor. The centrifuge of the present invention further includes a one-way clutch coupled to the harmonic drive unit for preventing any reverse precession of the shaft coupled to the conveyor when the brake rotor and confronting brake control surface are not engaged.

The centrifuge of the present invention also includes a conveyor that further comprises a plurality of paddles extending radially outward from a hub coupled to the shaft within the hollow spindle. Each of the paddles has an outer margin spaced from the inner surface of the bowl shell, with the scroll being fixed to the outer margins of the paddles immediately adjacent the bowl shell inner surface. The radially extending paddles interact with the liquid within the centrifuge to ensure a nearly uniform rotation of the liquid with the rotation of the bowl shell from the time of first introduction until the separated liquid leaves the bowl. The liquid is axially introduced into the centrifuge to impinge on a hub. The hub further comprises a distributor having an outer periphery extending outward to quickly rotationally accelerate the entering liquid so that incoming fluid to be separated is smoothly delivered to the region of the maximum operating fluid level within the bowl.

Additional features and advantages will become apparent to those skilled in the art upon consideration of the following specification, which when taken in conjunction with the drawings, sets forth the preferred embodiment of the present invention. The embodiment of the invention disclosed herein is the best mode contemplated by the inventors for carrying out the invention in a commercial environment, although it should be understood that various modifications can be accomplished within the parameters of the present invention.

DESCRIPTION OF A PREFERRED EMBODIMENTS

Figure 1:
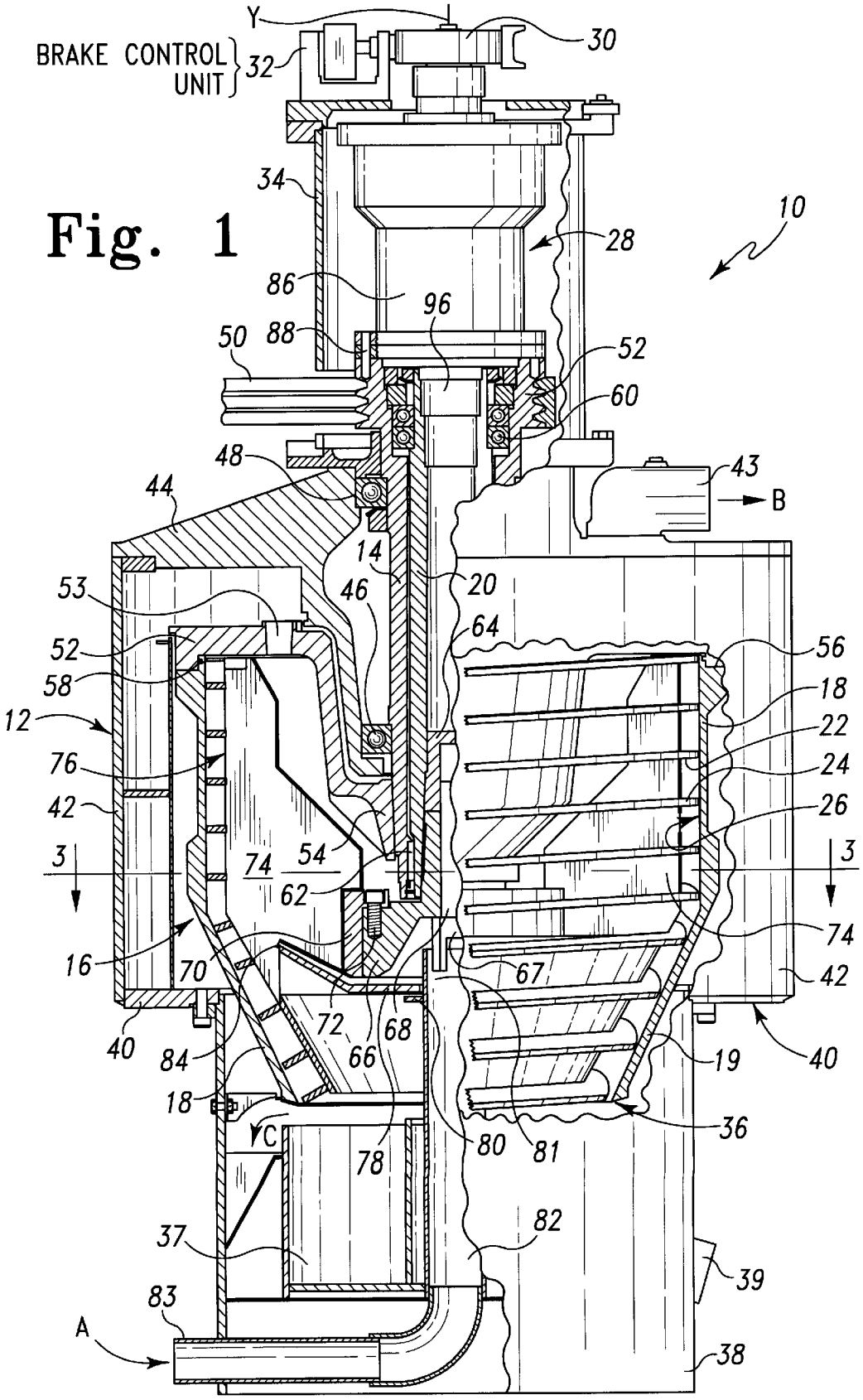
FIG. 1 is a side elevation view of a centrifuge of the present invention, partially broken away to show some interior portions thereof and more fully broken away and sectioned to show additional portions thereof.

A centrifuge 10 constructed in accordance with the present invention is shown generally in FIG. 1 to be enclosed within a frame 12. A hollow spindle 14 is supported by the frame 12 for rotation about an axis Y. A bowl 16, including a shell 18, is fixed to the spindle 14 for rotation with the spindle. A shaft 20 is situated within the hollow spindle 14 and is movable with respect to the spindle 14. A scroll conveyor 22 is fixed to shaft 20 and has an outer edge 24 which is situated immediately adjacent to an inner surface 26 of the bowl shell 18. A harmonic drive unit 28 is coupled to the upper end of the hollow spindle 14 and to the shaft 20 situated within the hollow spindle 14. A brake rotor 30 is also coupled to the harmonic drive unit 28, a brake control unit 32 is fixed to an upper portion 34 of frame 12 and includes a surface confronting the brake rotor 30. Activation of the brake control unit 32 while the bowl shell 18 is rotating causes engagement between the brake rotor and confronting surface of the brake control unit which in turn causes the harmonic drive unit 28 to precess the shaft 20 coupled to the conveyor 22 to effect relative movement between the conveyor 22 and the rotating bowl shell 18 thereby dispensing separated solids out of an open lower end 36 of bowl shell 18.

The frame 12 includes a base portion 38 forming a substantially cylindrical enclosure. A support ring 40 is fixed to the upper margin of the frame base portion 38 and is welded to the outside wall 42 which surrounds the bowl 16. Additional structural supports and framework can be added to the frame 12 as needed to position the centrifuge 10 at a desired height, and to provide service access to the centrifuge, which are matters of design outside of the focus of the present invention. The frame 12 includes an upper support plate 44 fixed to an upper margin of the outside wall 42 that includes a lower bearing 46 and an upper bearing 48. The hollow spindle 14 is rotatably supported by the bearings 46 and 48 and is caused to rotate by means of a belt 50 coupled to an integral pulley portion 52 of hollow spindle 14. The belt 50 can be driven by any suitable power source (not shown). Means other than a belt can be employed to supply power to the hollow spindle 14, including gears or chains (not shown).

The bowl 16 includes a bowl top 52 having a central depending portion 54 which is fixed to the hollow spindle 14 below the lower bearing 48. An upper edge 56 of the bowl shell 18 joins and is sealed to a lower outer margin 58 of the bowl top 52. Thus, rotation of the hollow spindle 14 by application of power through belts 50 causes the bowl top 52 to rotate which, in turn, causes bowl shell 18 to rotate about axis Y. The rotation of the bowl shell 18 causes any liquid introduced into the bowl 16 to be displaced outward by centrifugal force with the mean operating fluid surface level being determined by the fluid outlets 53 in top 52.

Figure 3:
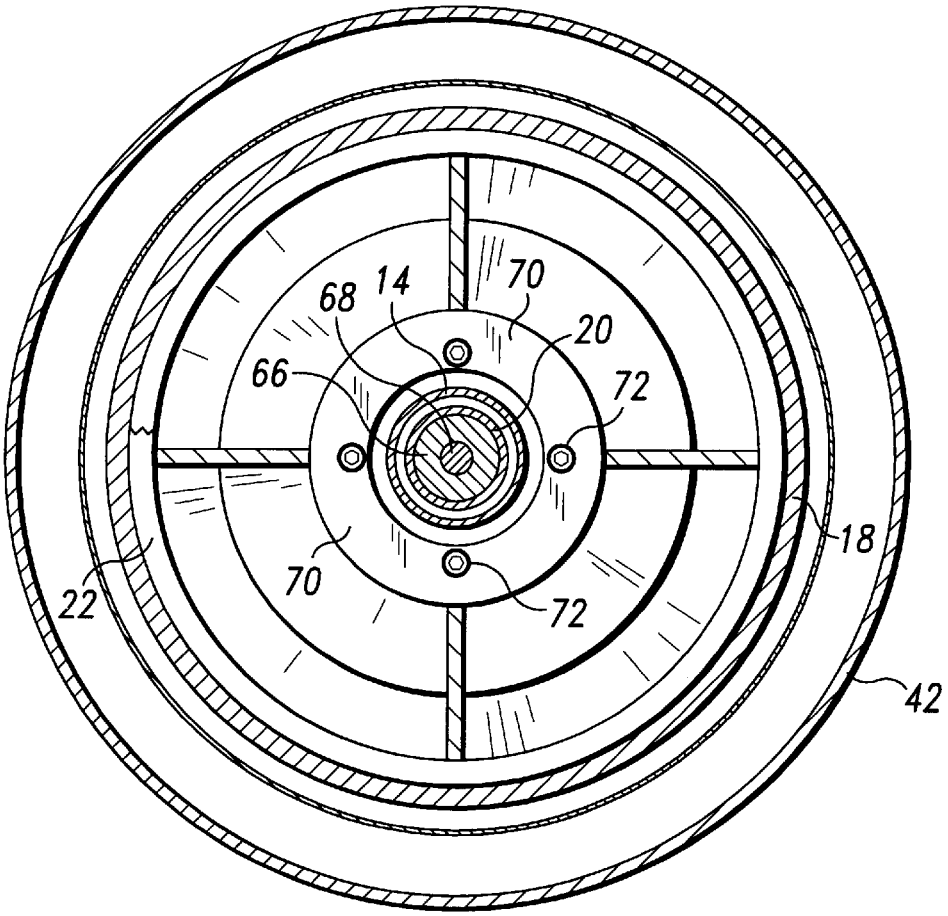
FIG. 3 is a sectional view taken along line 3—3 of the centrifuge shown in FIG. 1.

A bearing 60 is situated on the inside of the hollow spindle 14 near the upper end thereof. A needle bearing 62 is provided on the inside of the lower end of hollow spindle 14. The shaft 20 is supported by bearings 60 and 62 within the hollow spindle 14 to permit relative movement between the shaft 20 and hollow spindle 14. A stub shaft 64 is fixed within the lower portion of shaft 20. A hub 66 is secured to the stub shaft 64 by a bolt 68. A conveyor support ring 70 is secured to the hub 66 by a series of fasteners 72 also shown in FIG. 3. A plurality of paddles or fins 74 are fixed to the conveyor support ring 70 and extend radially outwardly to a point spaced from the inner surface 26 of bowl shell 18. The conveyor scroll 22 is fixed to and supported by the outer margins 76 of the paddles or fins 74 so that relative movement between the shaft 20 and hollow spindle 14 will in turn cause relative movement between conveyor 22 and bowl shell 18. A dish-shaped distributor plate 78 is secured to hub 66 and includes a central aperture 80 surrounding an upper end 81 of intake pipe 82. The outer margin 84 of the distributor plate 78 is situated generally in line with the mean operating fluid surface level as determined by the fluid outlets 53 in top 52. The outer margin 84 of the distributor plate 78 is situated at a radius from axis Y greater than the radius of the opening 36 in the bottom of the bowl shell 18.

Figure 2:
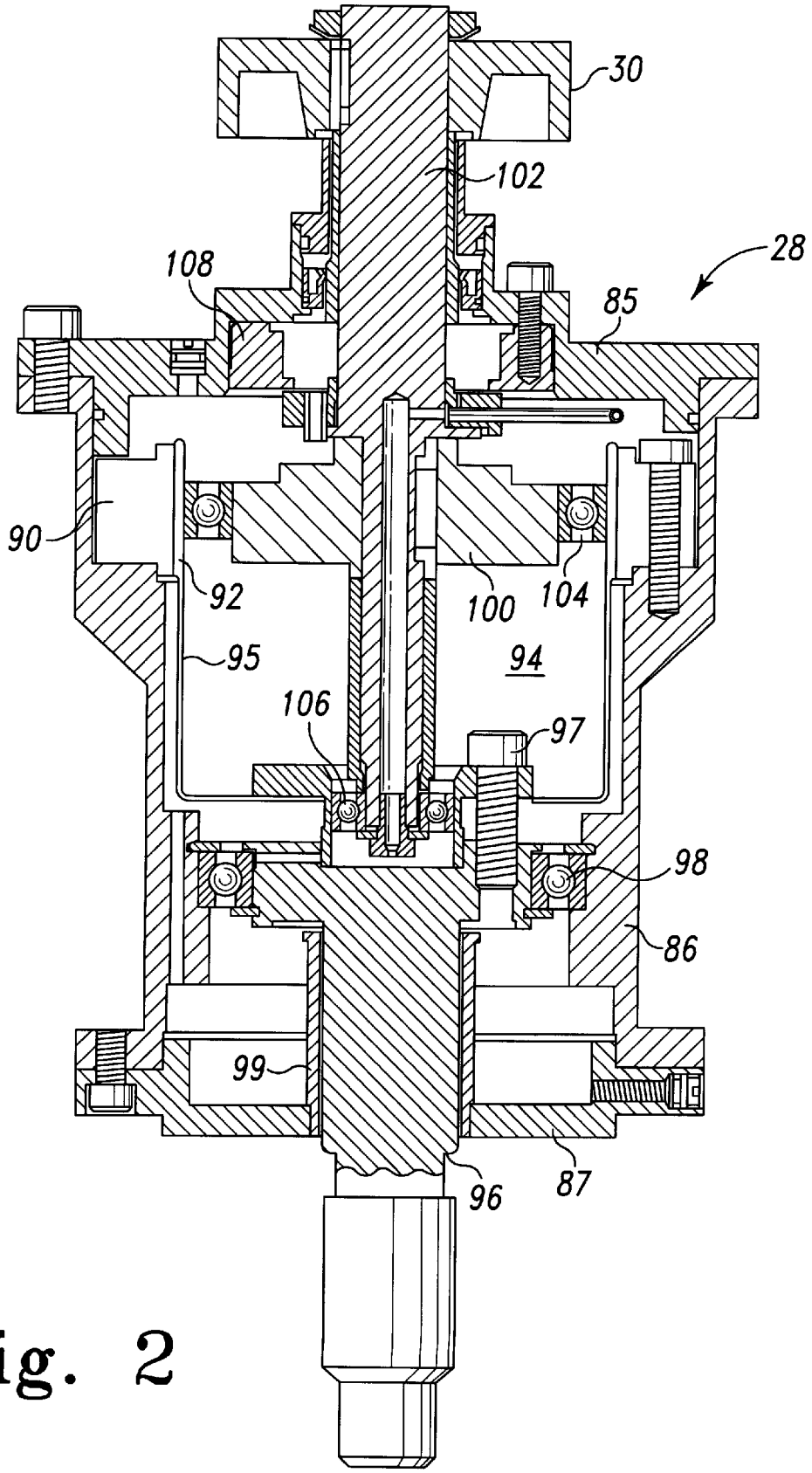
FIG. 2 is a sectional view of a speed differential apparatus in the form of a harmonic drive unit useful in the present invention.

The harmonic drive 28, shown in greater detail in FIG. 2, includes an outer housing 86 which is fixed to the upper end of hollow spindle 14 by a series of fasteners 88 shown in FIG. 1. Thus, rotation of hollow spindle 14 by application of power through belts 50 causes the entire harmonic drive 28, including the outer housing 86, to also rotate. The structure of the harmonic drive is conventional and is described in greater detail, for example, in U.S. Pat. Nos. 4,715,247 and 5,269,202. Briefly, the harmonic drive 28 includes an upper end plate 85 and a lower end plate 87 fixed to the outer housing 86. The harmonic drive 28 also includes a circular spline 90 fixed to the interior of housing 86. A flexspline gear ring 92 is situated within and engaged with the circular spline 90. The flexspline gear ring 92 typically takes the form of the upper edge of a cup 94 having wall 95 sufficiently thin that the upper margin including the flexspline gear 92 can be distended toward and away from engagement with the circular spline 88. The bottom of the cup 94 carrying the flexspline gear 92 is secured to a shaft 96 by fasteners 97, the shaft 96 being supported in bearings 98 and bushing 99 with respect to the housing 86 so that the shaft 96 can rotate with respect to the housing 86. The lower end of shaft 96 is secured to the inside of the upper end of shaft 20 as shown in FIG. 1.

The harmonic drive 28 also includes a wave generator disk 100 which is secured to shaft 102. T he outer edge of wave generator disk 100 is typically elliptical or some other shape which includes one or more lobes capable of displacing the flexspline gear 92. A bearing 104 situated between the wave generator 100 and the flexspline 92 facilitates rotation of the wave generator within the cup 94 so that the teeth of the flexspline gear 92 can repeatedly engage and disengage from the circular ring gear 90. The lower end of shaft 102 is supported in bearing s 106 with respect to the cup 92.

A one-way clutch 108 is included within the upper end 85 of the harmonic drive 28 so that shaft 102 can only rotate in a single direction relative to the housing 86. For the purpose of the present centrifuge, this one-way clutch could be situated at the bottom end 87 of the housing 86 to permit shaft 96 to rotate in only a single direction with respect to housing 86. The placement of the one-way clutch 108 in the upper end 85 of the housing 86 is merely to facilitate ease of repair should that become necessary. The purpose for the one-way clutch in association with the centrifuge as a whole will become apparent from the following discussion of the operation of centrifuge.

The bowl 16 is caused to rotate within the frame 12 by virtue of power applied to the pulley portion 52 of hollow spindle 14 by belt 50. The rotation of hollow spindle 14 also causes housing 86 of the harmonic drive 28 to rotate at the same speed. The flexspline gear 92 within the harmonic drive 28 is engaged with the circular gear 90 fixed to the housing 86 and hence, in the absence of any relative movement of the wave generator 100, the flexspline gear cup 92 also spins at the same angular speed thus causing shaft 96 to spin at this same speed. This in turn insures that shaft 20 which is fixed to the lower end of shaft 96 will rotate at the same speed as hollow spindle 14. This insures that the series of paddles or fins 74 joined by hub 66 to the bottom of shaft 20 will also spin with the same speed as the bowl 16 including the bowl shell 18.

A fluid including a particulate component is introduced into the end 83 of intake pipe 82 in the direction of arrow A. The fluid impinges on the head 67 of bolt 68 and is directed outward between hub 66 and distributor plate 78. The fluid enters a peripheral region of the bowl 16 radially outside the fluid exit port 53 where the particular component is caused to settle on the inside wall 26 of bowl shell 18 due to the centrifugal force of the fast rotating fluid. Once the particulate component has been removed, the cleaned fluid exits the rotating bowl 16 through port 53 and exits the centrifuge as a whole through outlet port 43 in upper support plate 44 in the direction of arrow B.

Following a period of separation of the particulate materials from the fluid entering the centrifuge 10, a layer of particulate material will be formed on the inside surface 26 of bowl shell 18. In order to remove this layer of material, the brake control 32 is caused to actuate so that a confronting surface of the brake control 32 frictionally engages the brake rotor 30 fixed to the top of shaft 102. This in turn causes the wave generator 100, fixed to shaft 102, to stop within the rotating housing 86 and flexspline cup 94. The relative movement between the flexspline cup 94 and the wave generator 100 causes the flexspline gear 92 to precess, that is, advance slowly, with respect to the rotating housing 86, in a forward direction so that the flexspline cup 94 and shaft 96 actually rotate with speed greater than housing 86 and hollow spindle 14. This greater rotational speed of shaft 96 causes a similar greater rotational speed of shaft 20 which in turn causes the helical scroll conveyor 22 to scroll downwardly relative to the inside wall 26 of rotating bowl shell 18. This downward displacement causes the particulate material which is settled on the inside wall 26 of the rotating bowl shell 18 to be displaced toward the beach portion 19 of bowl shell 18 thereby removing the liquid from the particulate material. As the particulate material reaches the lower edge 36 of bowl shell 18, the particulate material is displaced centrifugally outwardly and gravitationally downwardly in the direction of arrow C and falls out the bottom of the frame base portion 38 into a waiting receiver (not shown).

In the event it becomes necessary to stop the rotation of the bowl 16, the flow of liquid in through inlet pipe 82 is first terminated and then power is removed from drive belt 50. As the bowl 16 slows from its usual rotation speed, typically about 1,800 rpm, the liquid which is normally displaced radially outwardly within the bowl 16 reacts gravitationally to fall downward out the end 36 of the bowl into receiver trap 37. This small amount of partially treated liquid can be disposed of through opening 39 or recycled for treatment once the apparatus is again operational.

The present invention having been described in its preferred embodiment, it is clear that the present invention is susceptible to numerous modifications and embodiments within the ability of those skilled in the art and without exercise of the inventive faculty. Accordingly, the scope of the present invention is defined as set forth by the scope of the following claims.

What is claimed is:

1. A centrifuge including a frame, a hollow spindle supported by the frame for rotation about an axis, a bowl including a shell fixed to the spindle for rotation with the spindle, a shaft situated within and movable with respect to the hollow spindle, a conveyor fixed to the shaft including a scroll situated adjacent an inner surface of the bowl shell, and further comprising a harmonic drive unit coupled to an end of the hollow spindle and to said shaft situated within the hollow spindle, a brake rotor coupled to an element of the harmonic drive unit, and a brake control unit fixed to the frame, the brake control unit including a surface confronting the brake rotor for frictional engagement therewith, so that engagement of the brake rotor and confronting surface during rotation of the bowl shell will cause the harmonic drive unit to precess the shaft coupled to the conveyor to effect a relative movement between the conveyor and the rotating bowl shell, thereby dispensing separated solids out of the bowl shell.

2. The centrifuge of claim 1 wherein the harmonic drive unit comprises a housing fixed to an end of the hollow spindle, the housing containing a circular spline fixed to the housing.

3. The centrifuge of claim 2 wherein the harmonic drive unit further comprises a flexspline gear ring situated within and engaged with the circular spline, the flexspline gear ring being fixed to said shaft situated within the hollow spindle.

4. The centrifuge of claim 3 wherein the harmonic drive unit further comprises a wave generator positioned within the flexspline gear ring for displacing the flexspline gear ring with respect to the circular spline, the wave generator being fixed to said brake rotor.

5. The centrifuge of claim 1 further comprising a one-way clutch coupled to the harmonic drive unit for preventing any reverse precession of the shaft coupled to the conveyor.

6. The centrifuge of claim 1 wherein the conveyor further comprises a plurality of paddles extending radially outward from a hub coupled to the shaft, each of the paddles having an outer margin spaced from the inner surface of the bowl shell, the scroll being fixed to the outer margins of the paddles immediately adjacent the bowl shell inner surface.

7. The centrifuge of claim 6 wherein the bowl shell includes an edge at one end defining a circular opening centered on said axis and wherein the hub further comprises a distributor having an outer periphery extending outward to a selected radius greater than the radius of the bowl shell circular opening.

8. A centrifuge including a frame, a hollow spindle supported by the frame for rotation about an axis, a bowl including a shell fixed to the spindle for rotation with the spindle, a shaft situated within and movable with respect to the hollow spindle, a conveyor fixed to the shaft including a scroll situated adjacent an inner surface of the bowl shell, the centrifuge further comprising: a harmonic drive unit including a housing fixed to an end of the hollow spindle, the housing containing a circular spline fixed to the housing, a flexspline gear ring situated within and engaged with the circular spline, the flexspline gear ring being fixed to said shaft situated within the hollow spindle, and a wave generator positioned within the flexspline gear ring for displacing the flexspline gear ring with respect to the circular spline, a brake rotor coupled to the wave generator and a brake control unit fixed to the frame, the brake control unit including a surface confronting the brake rotor for frictional engagement therewith, so that engagement of the brake rotor and confronting surface during rotation of the bowl shell will cause the flexspline gear, rotating relative to the wave generator, to precess relative to the circular spline whereby the shaft coupled to the conveyor is caused to move relative to the rotating bowl shell, thereby dispensing separated solids out of the bowl shell.

9. The centrifuge of claim 8 further comprising a one-way clutch operably coupled to the harmonic drive housing and to an axle coupling the wave generator to the brake rotor for preventing reverse precession of the wave generator.

10. The centrifuge of claim 8 further comprising a support plate fixed to the frame including at least one bearing, and wherein the spindle has an upper end and a lower end, the upper end being positioned above said support plate by said at least one bearing, the upper end including a pulley adapted to be coupled to at least one drive belt for spinning the spindle about said axis of rotation.

11. The centrifuge of claim 8 wherein the spindle has an upper end and a lower end, and wherein the bowl comprises a top fixed to the spindle lower end to spin with the spindle, the bowl top having an outer periphery and having a plurality of openings at a selected radius from the axis of rotation, the plurality of openings in the bowl top defining a maximum operating fluid level within the bowl when the bowl is spinning.

12. The centrifuge of claim 11 wherein the bowl shell comprises an upper edge fixed to depend from the outer periphery of the bowl top, the bowl shell inner surface including an inwardly tapered lower portion forming a beach, the lower portion terminating in a circular downwardly facing opening having a radius less than said selected radius for the plurality of openings in the bowl top.

13. The centrifuge of claim 11 further comprising a hub coupled to a lower end of said shaft and including a distributor having an outer periphery extending outward to the selected radius for the plurality of openings in the bowl top.

14. The centrifuge of claim 13 further comprising a fluid inlet conduit having an open end confronting the distributor so that incoming fluid to be separated is smoothly delivered to said maximum operating fluid level within the bowl.

15. The centrifuge of claim 8 wherein the conveyor further comprises a plurality of paddles extending radially outward from a hub coupled to the shaft, each of the paddles having an outer margin spaced from the inner surface of the bowl shell, the scroll being fixed to the outer margins of the paddles immediately adjacent the bowl shell inner surface.

16. A centrifuge comprising:

a frame including a lower portion and an upper portion, the upper portion including a support plate, a hollow spindle rotatably supported by the support plate, the spindle having an upper end and a lower end, the upper end being positioned above the support plate and including a pulley adapted to be coupled to at least one drive belt for spinning the spindle about an axis of rotation, a bowl top fixed to the spindle lower end to spin with the spindle, the bowl top having an outer periphery and having a plurality of openings at a selected radius from the axis of rotation, a bowl shell having an upper edge fixed to depend from the outer periphery of the bowl top, the bowl shell having an inner surface including an inwardly tapered lower portion forming a beach, the lower portion terminating in a circular downwardly facing opening having a radius less than said selected radius for the plurality of openings in the bowl top, the plurality of openings in the bowl top defining a maximum operating fluid level within the bowl when the bowl is spinning, a shaft situated within the hollow spindle and rotatably movable with respect to the hollow spindle, a hub coupled to a lower end of the shaft and including a distributor having an outer periphery extending outward to the selected radius for the plurality of openings in the bowl top, a fluid inlet conduit fixed to the frame having an open end confronting the distributor so that incoming fluid to be separated is smoothly delivered to said maximum operating fluid level within the bowl, a conveyor fixed to the hub, the conveyor including a plurality of radially extending paddles and a scroll fixed to outermost edges of the paddles, the scroll positioned immediately adjacent the bowl shell inner surface, the scroll being movable with respect to the bowl shell inner surface upon rotation of the shaft with respect to the hollow spindle, a harmonic drive unit including a housing fixed to the upper end of the hollow spindle, the housing containing a circular spline fixed to the housing, a flexspline gear ring situated within and engaged with the circular spline, the flexspline gear ring being fixed to said shaft situated within the hollow spindle, a wave generator positioned within the flexspline gear ring for displacing the flexspline gear ring with respect to the circular spline, a brake rotor coupled to the wave generator and a brake control unit fixed to the frame, the brake control unit including a surface confronting the brake rotor for frictional engagement therewith, so that engagement of the brake rotor and confronting surface during rotation of the bowl shell will cause the flexspline gear, rotating relative to the wave generator, to precess relative to the circular spline whereby the shaft coupled to the conveyor is caused to move relative to the rotating bowl shell, thereby dispensing separated solids out of the downwardly facing bowl shell circular opening.

* * * * *